United States Patent [19]

Leung et al.

[11] 4,447,732

[45] May 8, 1984

[54] ION SOURCE

[75] Inventors: Ka-Ngo Leung, Hercules; Kenneth W. Ehlers, Alamo, both of Calif.

[73] Assignee: The United States of America as represented by the United States Department of Energy, Washington, D.C.

[21] Appl. No.: 374,847

[22] Filed: May 4, 1982

[51] Int. Cl.[3] ..... H01J 27/20

[52] U.S. Cl. ..... 250/427; 315/111.81; 376/144

[58] Field of Search ..... 250/423 R, 424, 427; 376/144; 313/363, 231.4, 161; 315/111.4, 111.6, 111.8, 111.81; 204/157.1 H

[56] References Cited

U.S. PATENT DOCUMENTS

| | | | |
|---|---|---|---|
| 3,030,543 | 4/1962 | Luce | 204/157.1 H |
| 3,760,225 | 9/1973 | Ehlers et al. | 315/111 |
| 3,766,396 | 10/1973 | Kruger et al. | 250/427 |
| 4,140,943 | 2/1979 | Ehlers | 376/144 |
| 4,383,177 | 5/1983 | Keller et al. | 250/423 R |

OTHER PUBLICATIONS

Ehlers et al., "Effect of a Magnetic Filter . . . ", *Rev. Sci. Instrum.*, 52(10), Oct. 1981.

Ehlers et al., "Characteristics of the Berkeley Multicusp Ion Source", *Rev. Sci. Instrum.*, 50(11), Nov. 1979.

Leung, "A Multipole Negative Ion Source", *Proceedings of the Symposium on the Production and Neutralization of Hydrogen Ions and Beams*, Sep. 1977.

*Primary Examiner*—Alfred E. Smith

*Assistant Examiner*—Jack I. Berman

*Attorney, Agent, or Firm*—Clifton E. Clouse, Jr.; Roger S. Gaither; Michael F. Esposito

[57] ABSTRACT

A magnetic filter for an ion source reduces the production of undesired ion species and improves the ion beam quality. High-energy ionizing electrons are confined by the magnetic filter to an ion source region, where the high-energy electrons ionize gas molecules. One embodiment of the magnetic filter uses permanent magnets oriented to establish a magnetic field transverse to the direction of travel of ions from the ion source region to the ion extraction region. In another embodiment, low energy 16 eV electrons are injected into the ion source to dissociate gas molecules and undesired ion species into desired ion species.

9 Claims, 9 Drawing Figures

ION SOURCE

The U.S. Government has rights in this invention pursuant to Contract No. W-7405-ENG-48 with the U.S. Department of Energy.

BACKGROUND OF THE INVENTION

1. Field of the Invention

This invention relates to ion sources and, more particularly, to an ion source using a magnetic filter to improve the ion beam quality.

2. Prior Art

For producing large volumes of uniformly distributed ions with densities exceeding $10^{12}$ ions/cc, present ion sources have limited capabilities. One important application of a hydrogen ion source is in neutral-beam injection systems for fusion energy experiments and reactors. Ions from such sources are initially electrostatically accelerated to high energies and subsequently neutralized to provide beams of high-energy, neutral atoms for these neutral-beam injection systems. The neutral-beam injection systems provide megawatts of energy for heating magnetically-confined plasmas in fusion energy devices such as tokamaks and mirror fusion devices. The initially cold, or low energy, plasma ions within these fusion energy devices are heated to high energies by being bombarded with high-energy particles. It has been found that the extremely high magnetic fields of these fusion energy devices not only effectively confine the plasma but also prevent charged particles from penetrating the plasma. Because neutral particles are not affected by magnetic fields, high-energy neutral particles provide a good choice for heating these fusion plasmas. When energetic neutral particles or atoms enter the fusion plasma, they are re-ionized by the plasma electrons. These energetic or hot ions are then contained by the reactor magnetic fields.

One important requirement for an ion source to be used in this type of application is that the ion source should have good beam quality, that is, generate a dense, uniformly intense, stable ion stream. Another important requirement for an ion source used in neutral-beam applications is that only certain desired ion species should be produced. For example, for a hydrogen ion source, it is important that as many of the $H^+$ ion species as possible are produced and that as few of the heavier $H_2^+$ and $H_3^+$ ion species as possible are produced. Positive hydrogen ions from a hydrogen ion source are first electrostatically accelerated to high energies. The high-energy positive ions are subsequently neutralized by being passed through a low-pressure gas cell where charge exchange neutralization takes place. When an $H^+$ ion is neutralized by charge exchange, it becomes a neutral H atom with the same energy as the $H^+$ ion. However, when a $H_2^+$ ion is neutralized by charge exchange, it becomes two neutral H atoms, each H neutral atom having one-half of the energy of the original $H_2^+$ ion. Similarly, an $H_3^+$ ion has one-third of the energy of an original $H_3^+$ ion. Less energetic neutral H atoms do not penetrate far enough into the plasma before being re-ionized. If they are re-ionized at the edge of the plasma they are thrown back out of the plasma to hit the container wall and cause wall damage as well as provide a source of unwanted impurities. It should be apparent that the overall efficiency and operating cost of a neutral-beam injection system is increased by improving the percentage of desired ion species delivered by an ion source.

A typical source for producing positive hydrogen ions is shown in U.S. Pat. No. 4,140,943, granted Feb. 20, 1979 to Kenneth W. Ehlers. Hydrogen is injected into a plasma generator vessel where it is ionized by a high-current discharge provided by a plurality of tungsten filaments.

SUMMARY OF THE INVENTION

It is an object of this invention to provide an ion source with an improved percentage of $H^+$ ions.

It is another object of this invention to provide an ion source which can be stably operated at high current levels and which has a uniform plasma density profile.

It is another object of this invention to provide an ion source which permits a lower voltage differential between the ionized plasma and the ion extractor to reduce sputtering and heat load on the extractor and to reduce arc over.

It is another object of this invention to provide an ion source which prevents undesired atoms from the ionization filaments from being extracted with desired ions.

To achieve the foregoing and other objects of the invention and in accordance with the purpose of the present invention, as embodied and broadly described herein, a method and apparatus are provided for improving the performance of a gas ionization source. The invention is particularly useful for improving the percentage of $H^+$ ions in a hydrogen ion source.

The apparatus according to the invention includes a vessel having an ionization chamber formed therein. The chamber is fed by a means for emitting high-energy ionizing electrons, that is, a source of high-energy electrons such as tungsten filaments, which emit electrons having sufficient energy to ionize the gas within the ionization chamber. In the case of a hydrogen ion source, the high-energy electrons have energies in the range of 70 to 80 eV. Extractor means are also provided to draw the positive ions from the ionization chamber. Magnetic filtering means, for example, permanent magnets, are also provided for establishing a magnetic field across the ionization chamber between the source of high-energy electrons and the extrator. The magnetic filter divides the ionization chamber into an ionizing zone and an ion extraction zone. The magnetic filtering means confines the high-energy electrons to the region near the source of high-energy electrons and prevents these electrons from interacting with gas molecules in the extractor zone where these high-energy electrons would increase the percentages of undersired $H_2^+$ and $H_3^+$ ions. To dissociate hydrogen molecules and undesired ions, low-energy 16eV electrons are injected into the extraction zone. One preferred embodiment of the invention provides the magnetic filtering means with permanent magnets located within the vessel and fixed in position within a tube having a cooling channel formed therein.

In addition to providing an improved percentage of desired ion species and a uniformly intense ion flux, the differential voltage between the plasma and the extractor is lower with the attendant benefit that sputtering, heating, arcing are reduced. The magnetic filtering means also prevents undesired filament ions, such as tungsten ions, from being extracted and contaminating the ion beam flux.

According to another aspect of the invention, 16eV electrons are injected into either the ionization zone or the extraction zone of the chamber in order to dissociate hydrogen molecules and the undesired $H_2^+$ and $H_3^+$ hydrogen ions into $H_1^+$ ions.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the invention and, together with the description, serve to explain the principles of the invention. In the drawings.

DETAILED DESCRIPTION OF THE PREFERRED EMBODIMENT

Reference is now made in detail to the present preferred embodiment of the invention which illustrates the best mode presently contemplated by the inventors of practicing the method and apparatus of the invention, a preferred embodiment of which is illustrated in the accompanying drawings.

Figure 1:
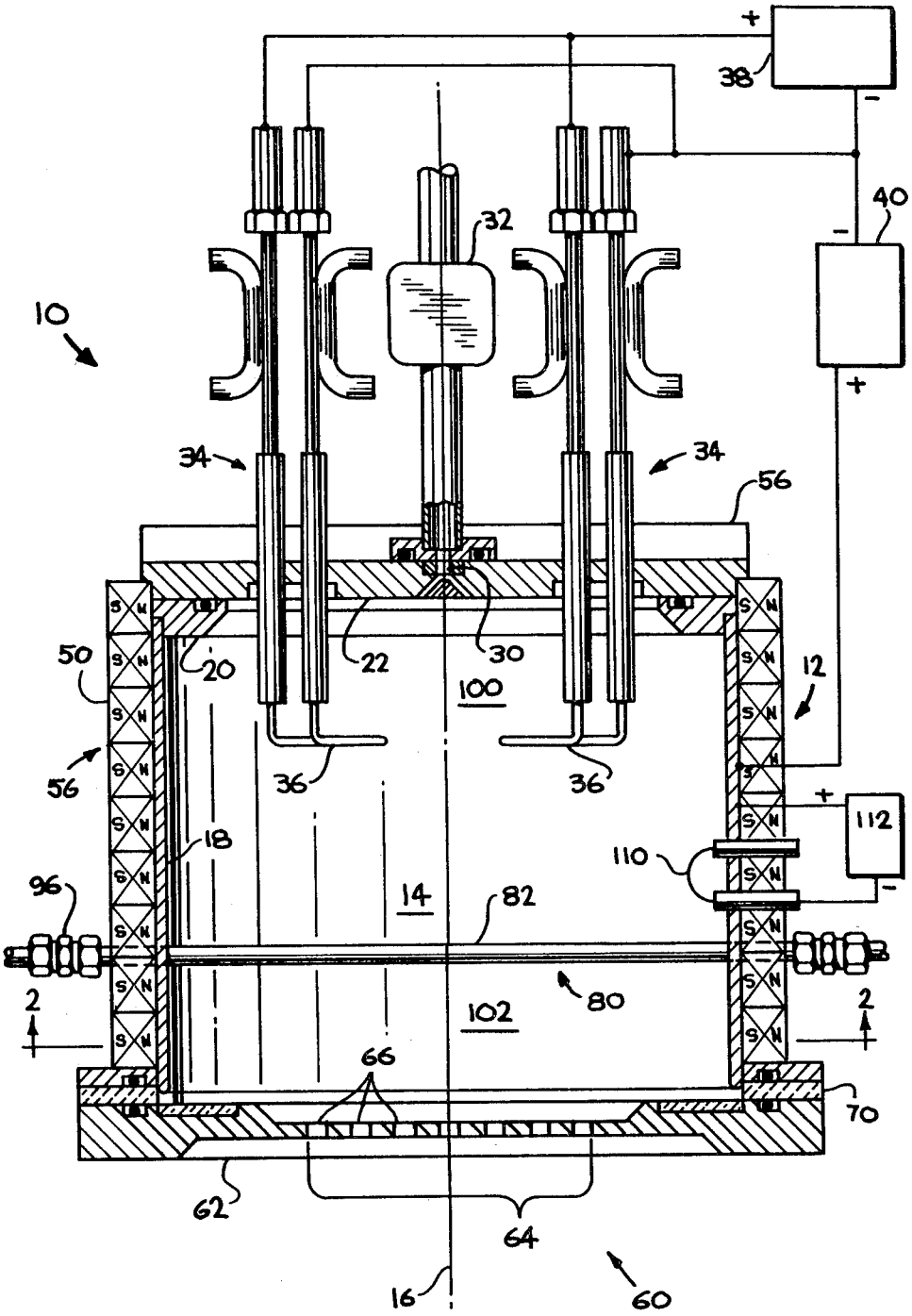
FIG. 1 is a longitudinal partially sectional view of an ion source incorporating the invention.
Figure 2:
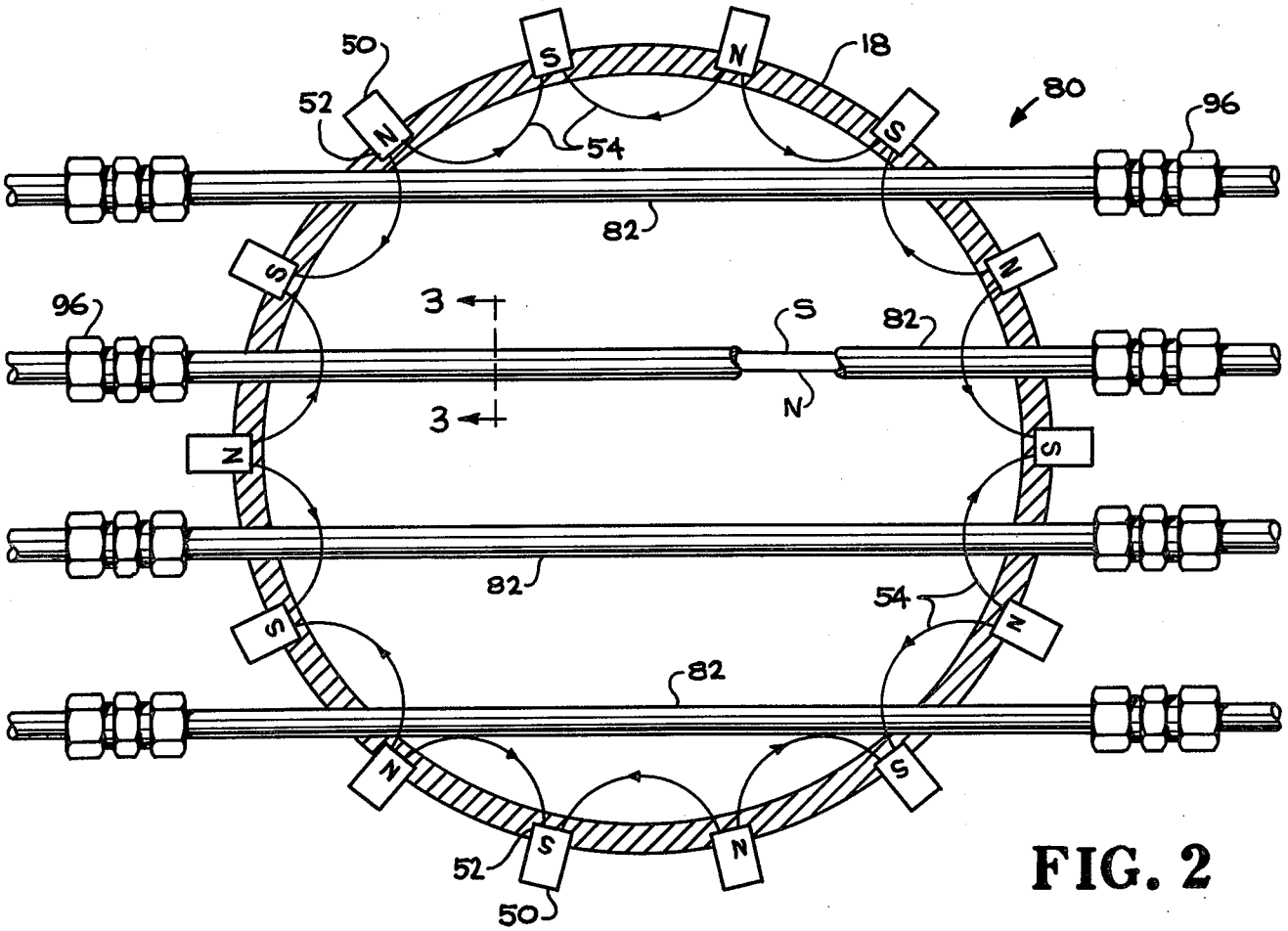
FIG. 2 is transverse sectional view taken along section line 2—2 of FIG. 1.

Referring to the drawings, FIG. 1 shows an embodiment of an ion source 10 for generating a flow of positive hydrogen ions. An ionization vessel 12 with a rectangular or circular cross-section, as shown in FIG. 2, has formed therein a cylindrical ionization chamber 14 centered around an axis 16 and having a conductive copper cylindrical body portion 18. One end of the chamber is closed by an end flange member 20 having a copper end plate 22 attached thereto. Hydrogen gas molecules are injected into the ionization chamber 14 through a passageway 30 formed in the end plate 22. A pulsed gas valve 32 is actuated to release hydrogen gas from a source, not shown, into the chamber just prior to ionization of that gas. In this embodiment of the invention, hydrogen gas is ionized by high-energy electrons, that is electrons having energies of 80 eV. A plurality of water-cooled filament assemblies 34 serve as means for emitting high-energy electrons. Each filament assembly 34 is mounted to the copper end plate 22 and has a tungsten filament 36 mounted at the end thereof and extending into the ionization chamber 14. Power to heat the tungsten filaments 36 is provided by an 8 Volt, 1000 A filament heater power supply 38. The filaments 36 supply electrons for a discharge and are powered by an 80 volt, 700 A. discharge power supply 40 having its negative terminal connected to each of the filament assemblies 34 and its positive terminals connected to the conductive body 18 of the ionization vessel 12. The filaments 36 are the cathodes and the conductive body 18 is the anode for the discharge.

A multi-cusped ion source is shown in FIGS. 1 and 2. The ion source has a magnetic field which helps to confine an ionized plasma within the vessel by preventing ions and electrons from colliding with the interior walls of the ionization vessel 12. A plurality of spaced-apart samarium cobalt permanent magnets 50 having a field strength of 3.6 kG are fixed into grooves 52 located around the periphery of the main cylindrical body portion 18 and on the end plate 22 of the ionization vessel 12. FIG. 2 shows a groove 52 containing nine individual permanent magnets 50 arranged as shown in FIG. 1, side-by-side and adhesively bonded in place to form one elongated permanent magnet assembly 56. The permanent magnet assemblies 56 are arranged so that north and south poles alternate to provide a longitudinal multi-cusp configuration for the magnetic field, within the chamber 14, as diagramatically indicated by the magnetic field lines 54 shown in FIG. 2.

FIG. 1 shows a portion of an extractor means for extracting ions, that is, the ion extractor assembly 60 located at the other end of the cylindrical ionization vessel 12, opposite the cathode filaments 36. An ion extractor assembly typically includes a series of grid members biased at various voltages. For purposes of describing the present invention, only a first grid member 62 is shown. This first grid member 62 is called the plasma grid and is electrically biased to draw positive ions from the plasma contained within the ionization chamber 14. The central portion 64 of the first grid 62 has open spaces 66 therein which permit a large fraction of positive ions in the plasma to be accelerated by the voltage on the first grid and to pass therethrough to form a positive ion beam. A number of accelerated ions are intercepted by the first grid 62 and cause the first grid 62 to be heated by transfer of kinetic energy thereto so that the first grid 62 is made of molybdenum or copper to promote heat conduction. The ion extractor assembly 60 is shown attached to the ionization vessel 12 by means of an electrical insulator 70 which is formed, for example, of a machineable glass ceramic or anodized aluminum material so that, if desired, a voltage from an extractor bias source can be applied between the ionization plasma and the ion extractor. In previous ion sources, high-energy electrons also would impinge upon the first grid 62 and would charge it to a negative potential with respect to the plasma, thus promoting ion collisions with the grid 62 as well as arcing and unstable operation of the source.

Figure 3:
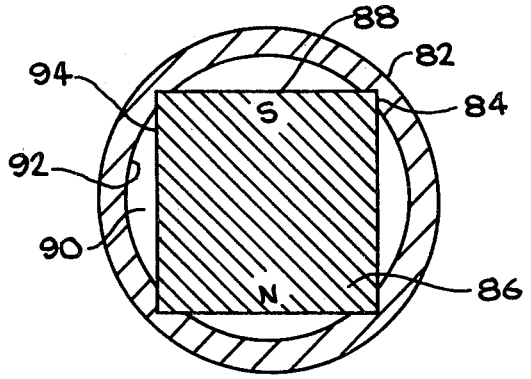
FIG. 3 is a cross-sectional view taken along section line 3—3 of FIG. 2 showing a portion of a permanent magnet and a tube for positioning and cooling the same.

One preferred embodiment of a means for reflecting high-energy electrons while allowing slower ions to pass therethrough is shown in FIGS. 2 and 3. A plurality of magnetic filter assemblies 80 provide a magnetic field which extends transverse to the vessel axis, in the general direction of which ions move as they are extracted and travel out of the plasma. The magnetic field provided repels the higher velocity electrons, in this case with energies of 70–80 eV, and confines them to that portion of the ionization chamber 14 adjacent to the filament assemblies 34, while permitting slower ions and low-energy cold electrons to pass. It is important that the high-energy electrons are repelled by the magnetic field because with no high-energy 80eV electrons present near the first grid 62, very few undesired $H_2^{30}$ and $H_3+$ ions are formed in the vessel 12 in the vicinity of the ion extractor assembly 60. Whenever high energy electrons are brought together with $H_2$ molecules, ionization occurs. It should be recognized that, when such ionization occurs, $H_2+$ and $H_3+$ ions are formed. It is desirable that such ionization takes place in only the vessel 12 near the filaments 36 when $H_2$ molecules are injected into the vessel from the pulsed gas valve 32. A significant advantage of this invention is that ionization of $H_2$ molecules occurs only in the region near the filaments and not near the extractor 60 even though $H_2$ molecules are present near the extractor. These $H_2$ molecules near the extractor 60 are from three sources. The first source is molecules which are injected from the gas valve 32 and which, being electrically neutral, drift past the magnetic filter. The second source of $H_2$ molecules is the first grid 62, on which ions impinge, become neutralized, and are sputtered away from. The third source is the ion neutralizer system located downstream from an ion source. These ion neutralizers use low-pressure $H_2$ gas for neutralizing accelerated ions by charge exchange. Some of the low-pressure $H_2$ gas finds its way back to the outlet region of the ion source near the extractor first grid 62. The ionization potential for H atoms is 13.6 eV and for $H_2$ molecules is about 16 eV. Ionization of $H_2$ molecules from the various sources will not therefore take place near the extractor if high-energy electrons, that is 80 eV electrons are not present. Higher powered ion sources having more dense plasmas produce less $H_2+$ and $H_3+$ ion species so that even with high-energy electrons being present, the percentage of $H+$ ions may be improved by increasing the plasma density in an ion source.

Another benefit of having the magnetic field extend across the vessel 12 is that tungsten from the filaments 36 is confined to the region near the filaments. After extended operation of an ion source using the invention, it was discovered almost no tungsten is found on the surface of the first extractor grid 62. In ion sources without the filtering magnetic field, tungsten is found on that grid. Using the magnetic filter assembly 80 can prevent undesired tungsten ions from contaminating the output ion flux. This is particularly important in applications such as for neutral beams.

Referring to FIGS. 2 and 3, a plurality of 6 mm. hollow copper tubes 82, spaced-apart by 4 cm., extend across the 20 cm, diameter interior of the ionization vessel 12 in a direction transverse to the axis 16. The tubes 82 extend through apertures in the wall of the main cylindrical body 18 of the ionization vessel 18 and are brazed thereto to provide a vacuum seal. The interior wall of the hollow copper tubes 82 are broached to provide a series of equally-spaced, longitudinally extending registration grooves 84 for receiving and fixing in position a number of ceramic permanent magnets 86. The ceramic permanent magnets 86 are each several centimeters long and have square cross sections with each side 88 thereof being 3.5 mm. The registration grooves 84 are formed so that they engage only the corner portions 88 of each ceramic permanent magnets 86. This provides longitudinally extending cooling channels, passageways 90, having boundaries defined by the interior surface 92 of the copper tube 82 and by the surface 94 of the ceramic permanent magnets 86. Threaded fittings 96 are located outside the ionization vessel 12 and are coupled to each end of a copper tube 82. This permits a cooling fluid, such as water, to flow through the cooling passageways 90 to cool the cooper tubes 82 which are heated by collisions with the plasma particles within the ionization vessel 12.

Figure 4:
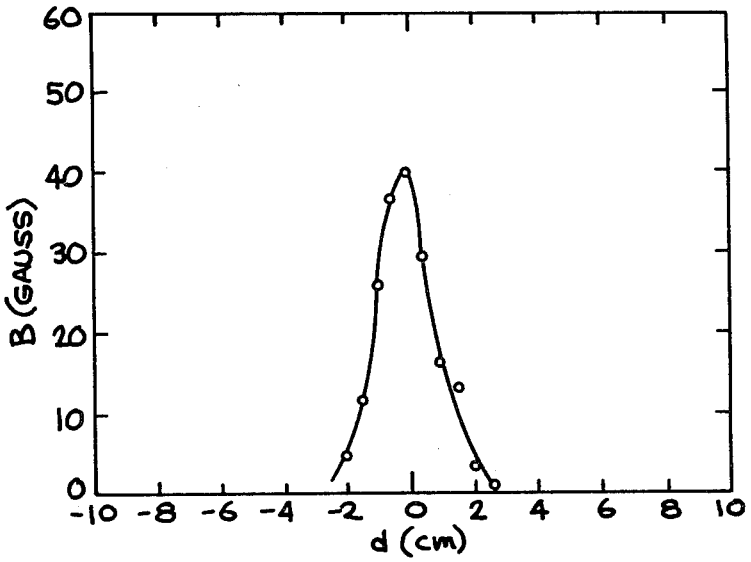
FIG. 4 is a graph plotting magnetic field strength versus distance from the filtering magnetic field provided in an embodiment of the invention.

The ceramic permanent magnets 86 for each assembly 80 are oriented within the hollow cooper tubes 60 such that adjacent magnet assemblies 80 have opposite poles facing each other. Ceramic permanent magnets 86 with a magnetic field of 40 Gauss and oriented as described, are a means for providing a filtering magnetic field transversely extending across and orthogonally positioned with respect to the longitudinal axis 16 of the ionization vessel 12. FIG. 4 shows a plot of the magnetic field B as a function of distance away from the plane in which the assemblies 80 lie. The filtering magnetic field divides the chamber 14 within the ionization vessel 12 into two regions.

The first region is an ion source region 100, or ionizing zone, formed between the copper end plate 22 and the magnetic filter assembly 80, forming a multi-cusp ion source with one end open for the passage of ions. High-energy electrons with relatively high velocities are confined in this region 100 by the magnetic field of the magnetic filter assembly 80, while lower velocity particles such as ions and low-energy electrons can pass through the magnetic filter. These low-energy electrons include electrons at an energy level that dissociates $H_2+$ and $H_3+$ ions. The reason why low-energy electrons can escape across the magnetic field is not fully understood, but some of the positive ions are believed to, in effect, drag some of these electrons along as the positive ions drift through the magnetic field toward first grid 62. The second region is an ion extraction zone 102 containing positive ions, low-energy electrons, and relatively few high-energy electrons. High-energy, high velocity, electrons are repelled by the magnetic field of the magnetic filter assembly 80 from entering the extraction zone 102 and producing undesired ion species as explained previously. Low-energy electrons are allowed to pass through the magnetic field of the magnetic filter assembly in order to dissociate $H_2+$ and $H_3+$ ions in the extraction zone into $H+$ ions thereby enriching the desired atomic species.

Figure 5:
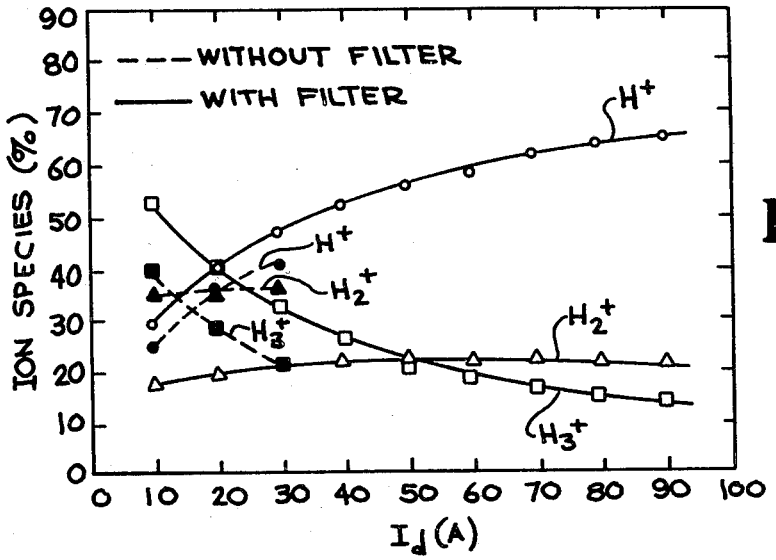
FIG. 5 is a graph plotting hydrogen ion species versus source current for an ionization source not using the invention and for an ionization source using permanent magnets to establish a filtering magnetic field according to the invention.

FIG. 5 shows that less $H_2+$ and $H_3+$ ions are formed in the ion extraction region when the magnetic field is present. The absence of high-energy electrons from the ion extraction zone 102 prevents further ionization of undesired hydrogen ion species of particles in the extraction zone.

FIG. 5 also shows that the maximum ion beam discharge current $I_d$(A) from a source with a magnetic filter is considerably increased before the ion source becomes unstable. Without the filter, the discharge could be operated no higher than 30 A before an instability occurred. With the magnetic filter for the case shown, stable discharges can be run at 90 A and higher. With the filter, source instabilities are not observed.

Figure 6:
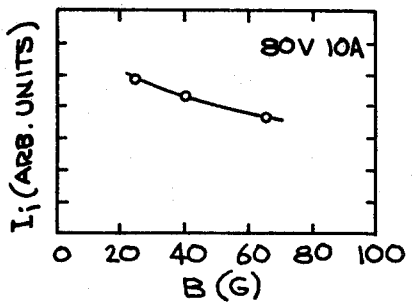
FIG. 6 is a graph plotting ion saturation current as a function of the filtering magnetic field strength.
Figure 7:
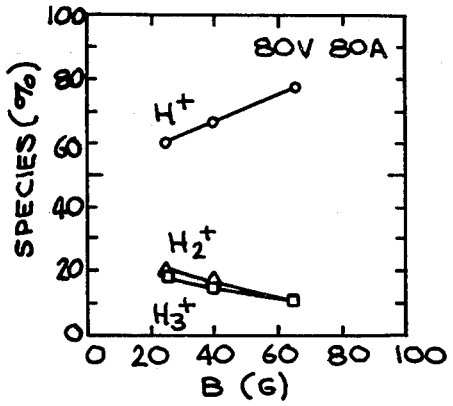
FIG. 7 is a graph plotting hydrogen ion species percentages as a function of the filtering magnetic field strength.

The plasma density in the ion extraction zone 102 is less than that in the ionization zone 100. The amount of reduction in ion current density is a function of the magnitude and spatial extent of the filtering magnetic field extending across the ionization vessel 12. In addition to the magnetic field, the magnetic filter's geometric transparency, that is, the available amount of open space, of the magnetic filter assembly 80 also will determine the current ion density in the ion extraction region 102. A stronger filter magnetic field will increase the percentage of desireable $H^+$ ions, but reduce the ion current density. FIG. 6 shows the ion saturation current a function of the magnetic field strength for as source using the invention. FIG. 7 shows the hydrogen ion species percentages as an increasing function of the magnetic field strength of the permanent magnets 86. Therefore, a tradeoff must be made between a tolerable percentage of undesired species and an acceptable ion current density. The 40 Gauss magnetic B-field of the permanent magnets 86 used in this embodiment provides a compromise current between maximum source current and maximum $H^+$ ion species percentage.

Figure 8:
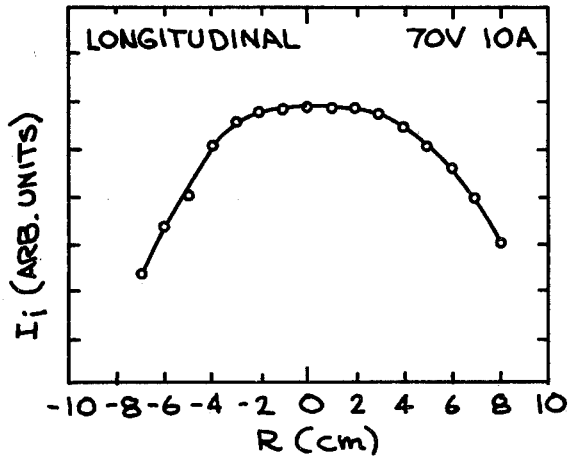
FIG. 8 is a graph plotting ion current density versus radius of the extraction electrode of an ion source without a magnetic filter assembly.
Figure 9:
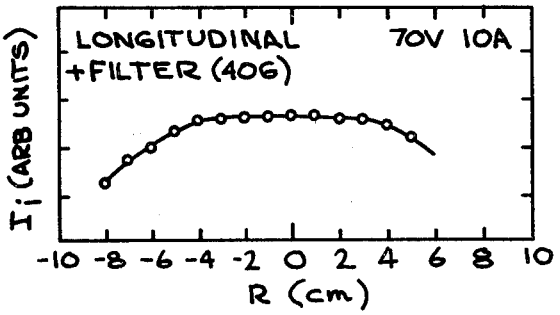
FIG. 9 is a graph plotting ion current density versus radius of the extraction electrode of an ion source with a magnetic filter assembly.

Use of the magnetic filter assembly 80 improves the ion current density profile. FIGS. 8 and 9 show the ion current density profile near the first grid 62, respectively, without a magnetic filter assembly and with a filter assembly.

The insulator 70 electrically insulates the ion extraction region 102 from the ion source region 100. By biasing the first grid 62 of the extractor assembly 60 several volts negative with respect to the ionization zone 100, the ion current density measured at the input to the extractor assembly 60 is increased by about 30%. An ion source using a magnetic filter assembly 80 according to the invention permits the voltage differential between the plasma and the first grid 62 of the ion extractor assembly to be reduced from about 30 volts negative to about 10 volts negative because it is not necessary to repel high energy electrons which might pass through the first grid 62. A beneficial result is that sputtering and heating of the first grid material, caused by ion collisions therewith, is reduced because of the lowered acceleration given to ions being extracted. Another result is that arcs between the ionization vessel wall 18 and the extractor first grid 62 are reduced.

Referring to FIG. 1, another aspect of a preferred embodiment of the invention is shown. Another filament 110 is located within the chamber 14. A 16 volts, 50A power supply 112 for operating the filament 110 applies 16 volts between the conductive vessel body 18 and the filament 110, which serve as a means for injecting 16 eV electrons into the ionization chamber 14. This further enhances the $H^+$ ion percentage by dissociating the $H_2$ gas molecules, which have a 15.8 eV ionizing potential, into two H atoms and by dissociating $H_2^+$ ions into an $H^+$ ion and an H atom. Also, less $H_3^+$ ions are formed because they requre $H_2^+$ ions which are reduced in number. For a 90 A ion discharge and a 40 Gauss filter magnetic field, it has been found that operating filament 110 at 40A increases the $H^+$ ion percentage from 72% to 81% with no significant change in the ion current density.

In summary, a method and apparatus for ionizing neutral particles has been described which, in the case of hydrogen, provides an improved percentage of desired $H^+$ ions with corresponding reductions in $H_2^+$ and $H_3^+$ ions. This is brought about by reflection of high-energy ionizing electrons from a filter which extends across the ionization chamber. The filter divides the chamber into an ionization zone, which contains the positive ions and high-energy electrons, and into an ion extraction zone, which contains positive ions but relatively few high-energy electrons. In the preferred embodiment, described above, filtering or screening of the high-energy electrons is provided by the magnetic field produced by water-cooled permanent magnets located within the ionizing chamber. In addition to improving the percentage of desired ions, the spatial distribution of the ion flux is improved and the ion flux output, or the current, is greatly increased. The introduction of 16 eV electrons into a hydrogenous plasma promotes further dissociation of hydrogen molecules and undesired $H_2^+$ and $H_3^+$ ions which further improves the percentage of $H_1^+$ ions.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto and their equivalents.

We claim:

1. An ion source for ionizing neutral hydrogen molecules and atoms into positive ions for neutral beam injection in a fusion energy system comprising:

a vessel having a chamber formed therein;

means coupled to the chamber for emitting high-energy ionizing electrons which collide with said hydrogen molecules and atoms to form a plasma of positive ions, said chamber being maintained at a positive potential with respect to said plasma;

extractor means coupled to the chamber to be biased at a low negative voltage with respect to said plasma for extracting said positive ions from the chamber, said low voltage being insufficient to cause said ions to heat and sputter said extractor means and insufficient to cause arcing between said extractor means and said chamber; and filtering means extending across said chamber reflecting high-energy electrons while allowing positive ions and cold electrons to pass therethrough, said reflecting means dividing the chamber into an ionizing zone, which communicates with the means for emitting high-energy ionizing electrons and which contains ions and high-energy electrons, and into an extraction zone, which contains positive ions and relatively few high-energy electrons so that undesired species of ions are prevented from being formed in the extraction zone due to the relative absence of high-energy electrons required for formation of said undesired ions;

said filtering means including a means for providing a magnetic field transverse to the direction of ions travelling from the ionizing zone to the extraction zone.

2. The ion source of claim 1 wherein the filtering means includes at least two permanent magnets.

3. The ion source of claim 2 wherein the permanent magnets are located within the chamber and including means for cooling the permanent magnets.

4. The ion source of claim 3 wherein the cooling means includes a tube having at least one channel for a cooling fluid.

5. The ion source of claim 4, wherein the tube includes a bore and includes means for holding the permanent magnets in fixed positions in the bore of said tube.

6. The ion source of claim 5 wherein the holding means includes grooves formed for holding the permanent magnets in position in the bore of said tube.

7. The ion source of claim 1 including a plurality of permanent magnets positioned around the exterior of the vessel having the chamber formed therein to form multi-cusped magnetic fields within said chamber fo repelling ions from contacting the vessel.

8. The ion source of claim 1 wherein the molecules and atoms are hydrogen and including means communicating with the chamber for injecting 16 eV electrons into said chamber for dissociating hydrogen molecules and undesired $H_2+$ and $H_3+$ ion species into $H_1+$ ions.

9. A method of reducing undesired ion species in a hydrogen ion source of a neutral beam injection system for a fusion energy system, comprising the steps of:

ionizing neutral hydrogen particles by emitting high-energy electrons into an ionization zone of a chamber formed in a vessel to form a plasma of positive ions, said chamber being maintained at a positive potential with respect to said plasma;

extracting the positive ions from the extraction zone with an extractor voltage to provide a positive-ion output flux, said extractor voltage being a low negative voltage with respect to said plasma;

filtering the high-energy electrons from the positive-ion output flux by reflecting said high-energy electrons with a magnetic field extending across the vessel between the ionization zone and an extractor zone from which the high-energy electrons are excluded so that undesired ion species are prevented from being formed, said magnetic field permitting cold electrons to pass from the ionization zone to the extraction zone.

* * * * *